US005180133A

United States Patent [19]

Chang

[11] Patent Number: 5,180,133

[45] Date of Patent: Jan. 19, 1993

[54] CLIPBOARD HAVING A CALCULATOR MOUNTED THEREON

[76] Inventor: Shih-Ho Chang, No. 2-12, Chang-Lu Rd., Chang-Hua City, Taiwan

[21] Appl. No.: 811,267

[22] Filed: Dec. 20, 1991

[51] Int. Cl.[5] ..... A47B 19/00

[52] U.S. Cl. ..... 248/452; 248/441.1; 248/176; 248/205.2; 248/314

[58] Field of Search ..... 248/452, 451, 453, 441.1, 248/450, 309.1, 221.4, 449, 314, 918, 176, 314, 205.2; 108/44

[56] References Cited

U.S. PATENT DOCUMENTS 4,955,576 9/1990 Moberg ..... 248/449

*Primary Examiner*—Alvin C. Chin-Shue

*Attorney, Agent, or Firm*—Baker & Daniels

[57] ABSTRACT

A clipboard includes a board and a clip member. A recess is formed at the outside face of the clamp member and is configured to receive a calculator. A positioning device is provided for detachably positioning the calculator in the recess of the clamp member. Therefore, the calculator can be easily removed from the clamp member because a large working space is available.

6 Claims, 8 Drawing Sheets

CLIPBOARD HAVING A CALCULATOR MOUNTED THEREON

BACKGROUND OF THE INVENTION

1. Field of the Invention

This invention relates to a clipboard having a calculator mounted thereon, more particularly to a clipboard having a calculator mounted on the outside of a clamp member provided on said clipboard.

2. Description of the Related Art

Calculators are useful tools for mathematical calculations. Typically, a pocket calculator is mounted on a clipboard to obviate the inconvenience caused by the necessity of positioning the calculator with one of the user's hands while the user's other hand holds a pen to write on the clipboard. Referring to FIGS. 1 to 3 U.S. Design Pat. No. 284,678 disclosed a clipboard comprises a clamp member 1, a board 2, a supporting base 3 fixed to the board 2, a torsional spring 4, and a pivot axle 5. The clamp member 1 is pivotally connected to two projections 31 with the pivotal axle 5 and cooperates with the board 2 to form a clamping device. The torsional spring 4 is arranged between the inside face of the clamp member 1 and the supporting base 3 to bias the clamp member 1 to abut against the board 2. The clamp member 1 has two lugs (1*b*) which extends downward from its two opposite edges to define a receiving portion (1*a*) at the inside face of the clamp member 1. The receiving portion (1*a*) is adapted to receive a calculator 6, and two folded portions (1*d*) are used for holding the calculator 6 within the receiving portion (1*a*). A plurality of holes (1*c*) are provided on the clamp member 1, exposing the keys 61 and the display 62 of the calculator 6 for viewing purposes. The torsional spring 4 abuts upon the back of the calculator 6 while the calculator 6 is positioned in the receiving portion (1*a*). However, the conventional clipboard suffers from the following disadvantages:

(1) When folded to clamp the calculator 6, the folded portions (1*d*) are likely to damage the internal electronic parts in the casing of the calculator 6 because of excess force.

(2) The display is likely to be damaged by the biasing force of the torsional spring 4.

(3) The disassembly of the calculator 6 in order to replace the battery means in the calculator 6 is troublesome because the folded portions (1*d*) of the clamp member 1 have to be stretched from the back side of the clamp member 1 where a little working space is available.

SUMMARY OF THE INVENTION

It is therefore a main object of this invention to provide a clipboard having a calculator mounted thereon in which the calculator can be easily disassembled from the clipboard.

It is another object of this invention to provide a clipboard having a calculator mounted thereon in which the calculator is not likely to be damaged due to the clamp and/or biasing force exerted by the positioning members.

Accordingly, the clipboard having a calculator mounted thereon of the present invention includes a board and a clip member. A recess is formed at the outside face of the clamp member and is configured to receive the calculator. A positioning means is provided for detachably positioning the calculator in the recess of the clamp member. Therefore, the calculator can be easily removed from the clamp member because a large working space is available.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE PREFERRED EMBODIMENTS

Figure 1:
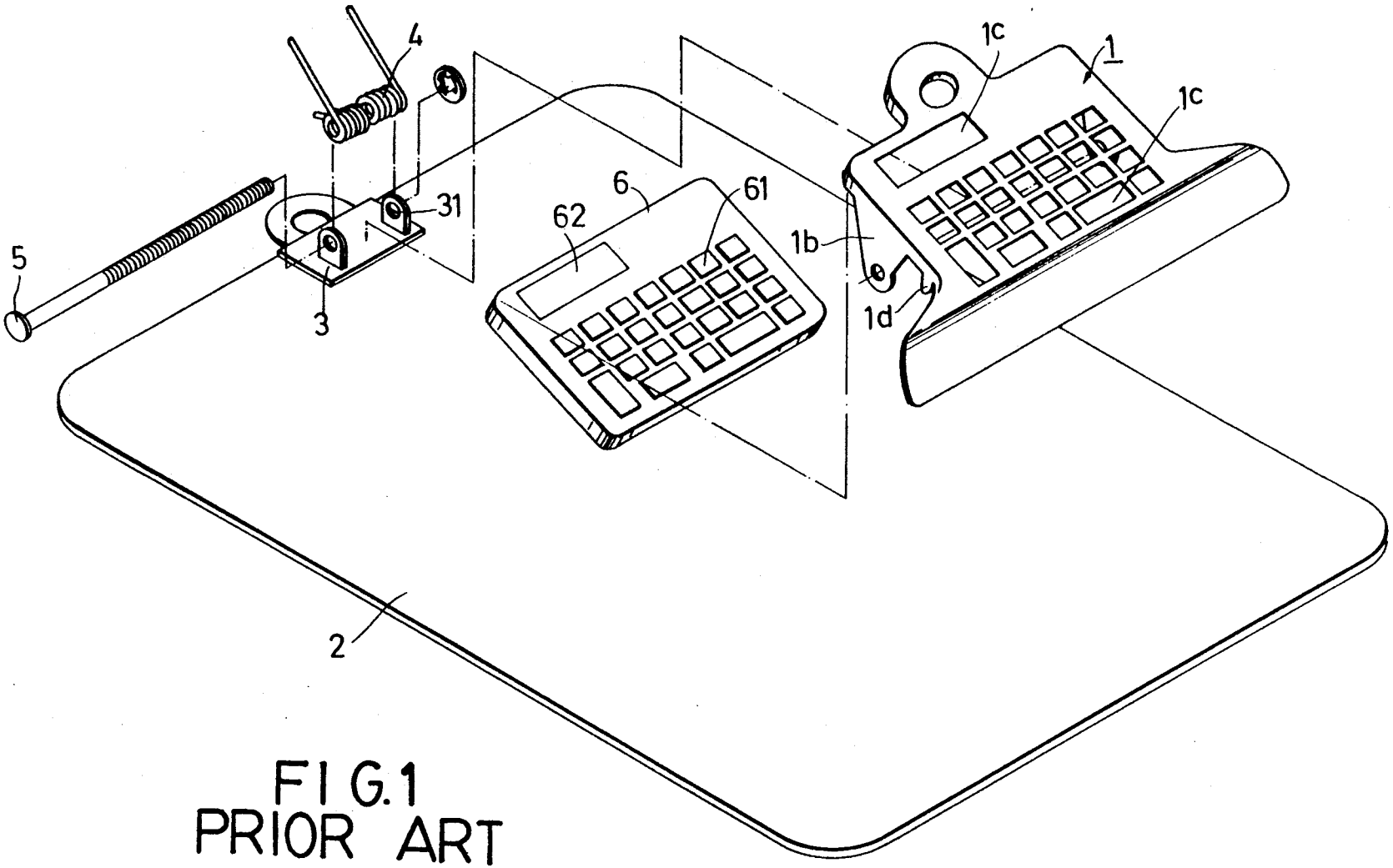
FIG. 1 PRIOR ART
FIG. 1 is a perspective exploded view of a conventional clipboard having a calculator mounted thereon.
Figure 2:
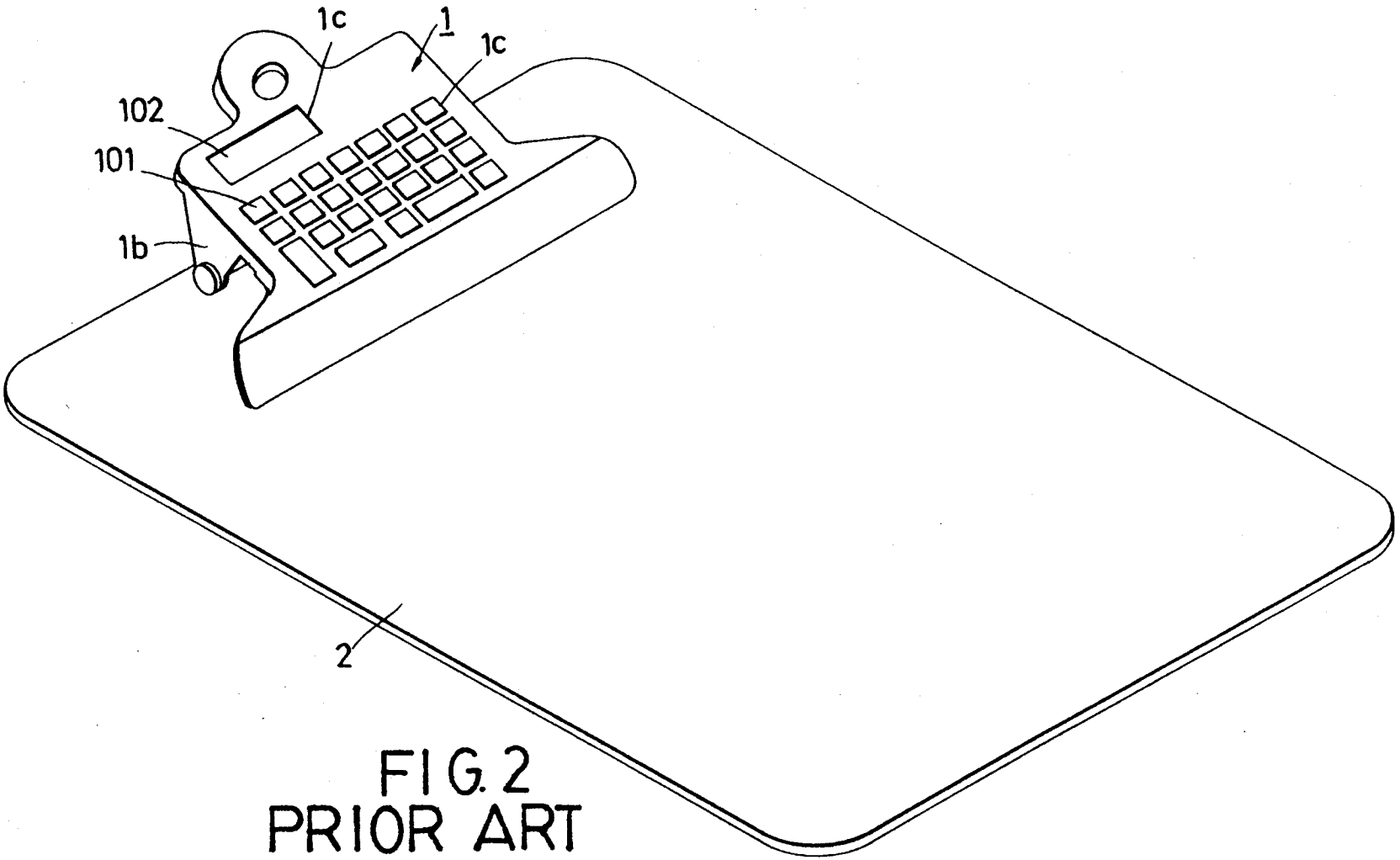
FIG. 2 PRIOR ART
FIG. 2 is a perspective view of a conventional clipboard having a calculator mounted thereon.
Figure 3:
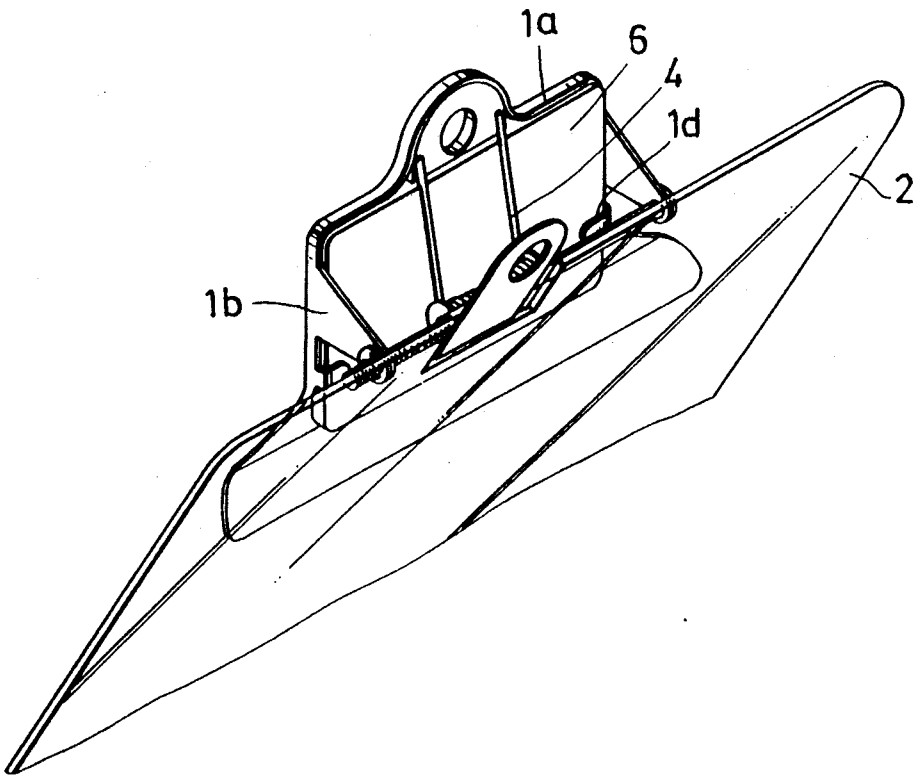
FIG. 3 PRIOR ART
FIG. 3 is a perspective rear view of a conventional clipboard having a calculator mounted thereon.
Figure 4:
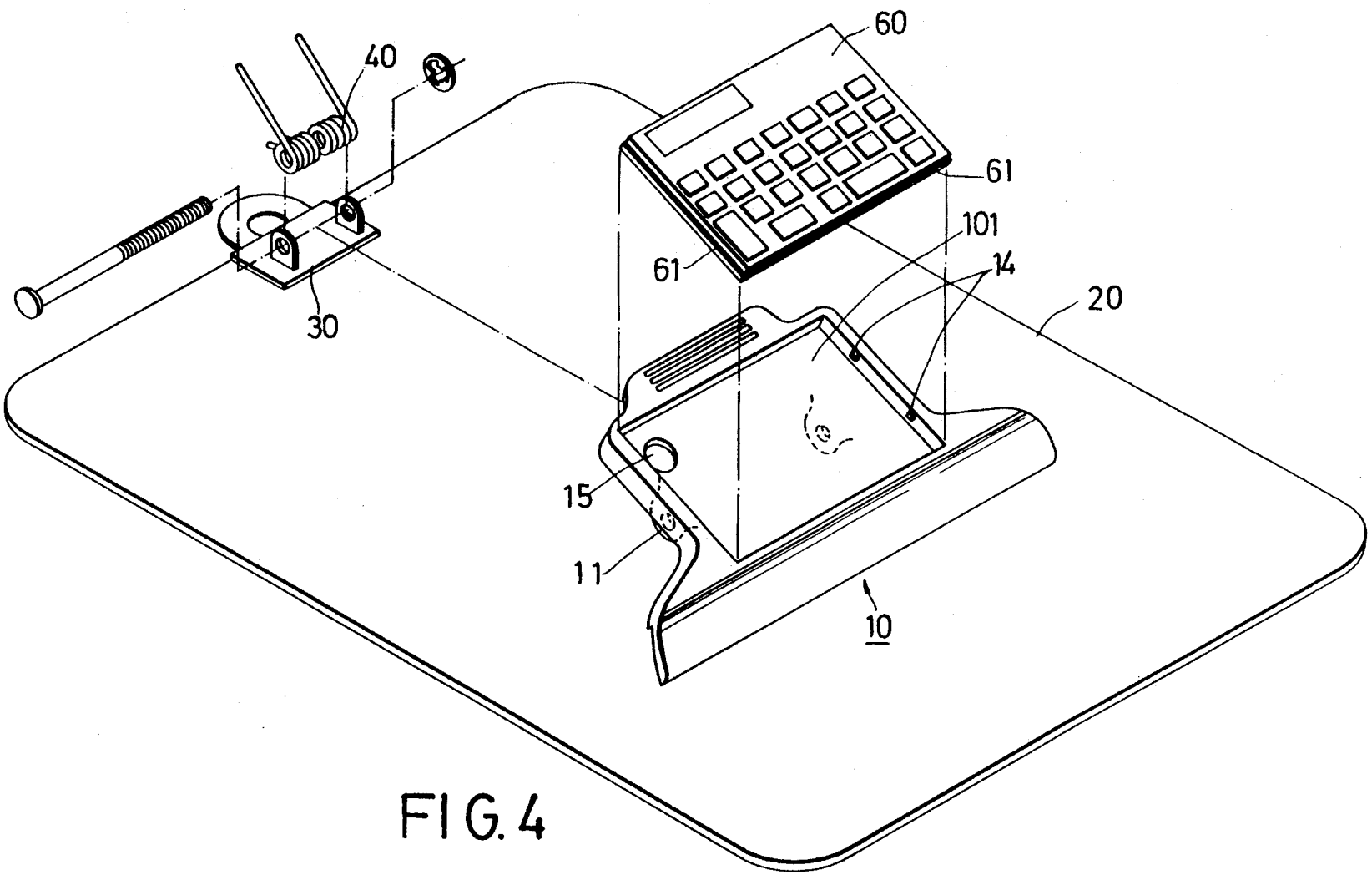
FIG. 4 is a perspective exploded view of a first preferred embodiment of a clipboard having a calculator mounted thereon according to this invention.
Figure 5:
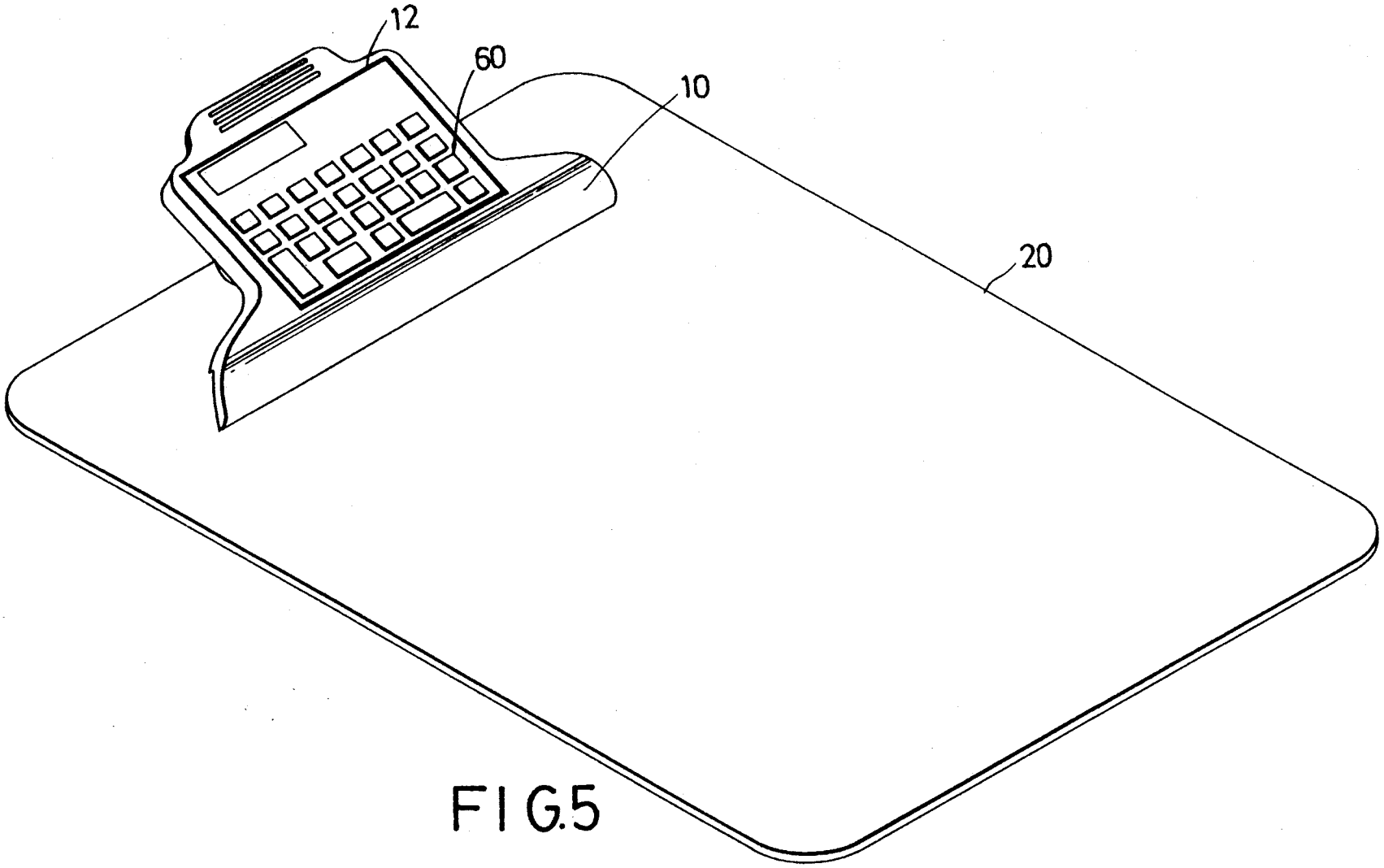
FIG. 5 is a perspective view of the first preferred embodiment of a clipboard having a calculator mounted thereon according to this invention.
Figure 6:
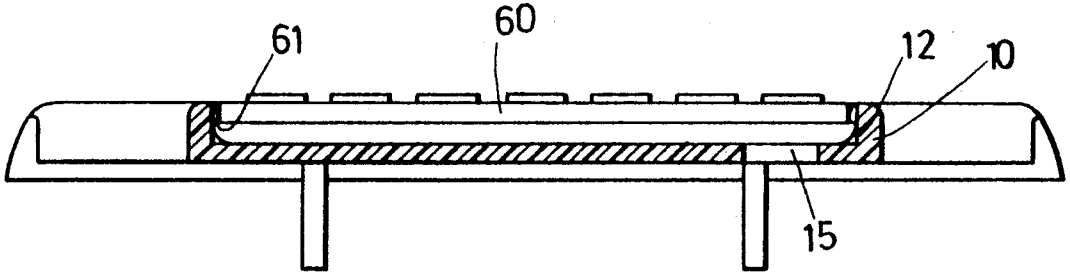
FIG. 6 is a sectional view of the first preferred embodiment of a clipboard having a calculator mounted thereon according to this invention.

Referring to FIGS. 4 and 5, a first preferred embodiment of a clipboard having a calculator 60 mounted thereon comprises a clamp member 10, a board 20, a supporting base 30 and a torsional spring 40. The board 20, the supporting base 30 and the torsional spring 40 are constructed and function as the conventional ones do. The clamp member 10 has two lugs 11 projecting inward from the opposite edges of the clamp member 10, which is pivotally connected to the supporting base 30, as in the prior art. The torsional spring 40 abuts against the inside face of the clamp member 10. The clamp member 10 has a generally rectangular recess 12 configured to receive a calculator 60. Two pairs of projections 14 are respectively formed in the opposite sides of the recess 12. Each of the projections 14 has a rounded upper face so that the calculator 40 can easily fit into the recess 12. The calculator 60 has a peripheral shoulder 61 which abuts against the lower face of the projections 14 of the clamp member 10 when the calculator 60 is fitted into the recess 12 and therefore positioned therein. In assembly, one side of the calculator 60 is inserted into the recess 12, and the shoulder 61 is allowed to abut against the lower faces of one pair of the projections 14. The opposite side of the calculator 60 is then forced into the recess 12 by sliding it over the rounded faces of the other pair of projections 14 on the opposite side of the recess 12. The peripheral shoulder 11 is then engaged with the lower faces of the other pair of projections 14, as best illustrated in FIG. 6. An aperture 15 is formed in the bottom of the recess 12 so that a user can push the calculator 60 out of the recess 12 by using, for example, a rod which passes through the aperture 15. Therefore, a user can easily remove the calculator 60 from the clamp member 10 in order to replace a battery means in the calculator 60.

Figure 8:
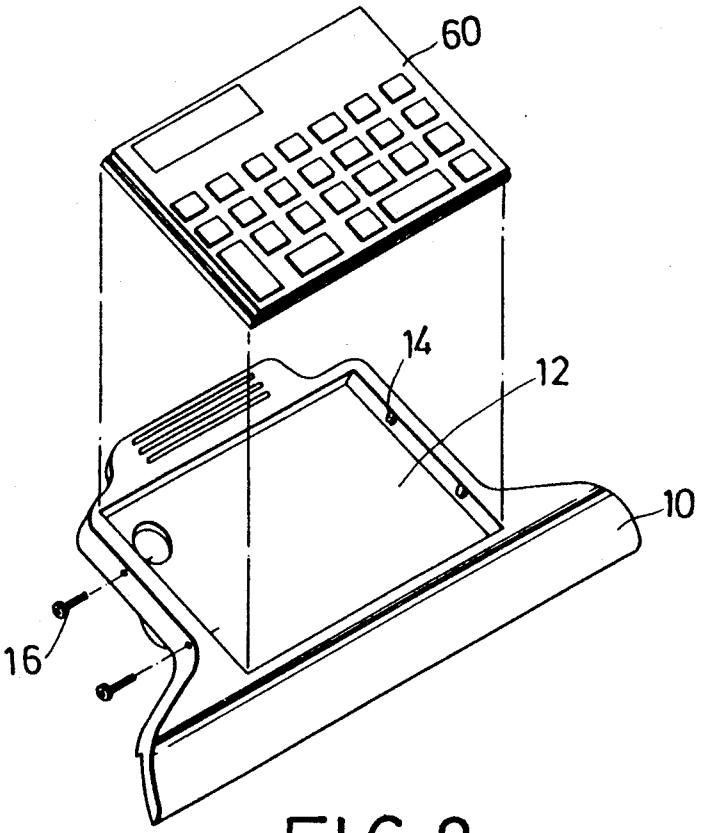
FIG. 8 is a perspective exploded view of a third preferred embodiment of a clipboard having a calculator mounted thereon according to this invention.
Figure 7:
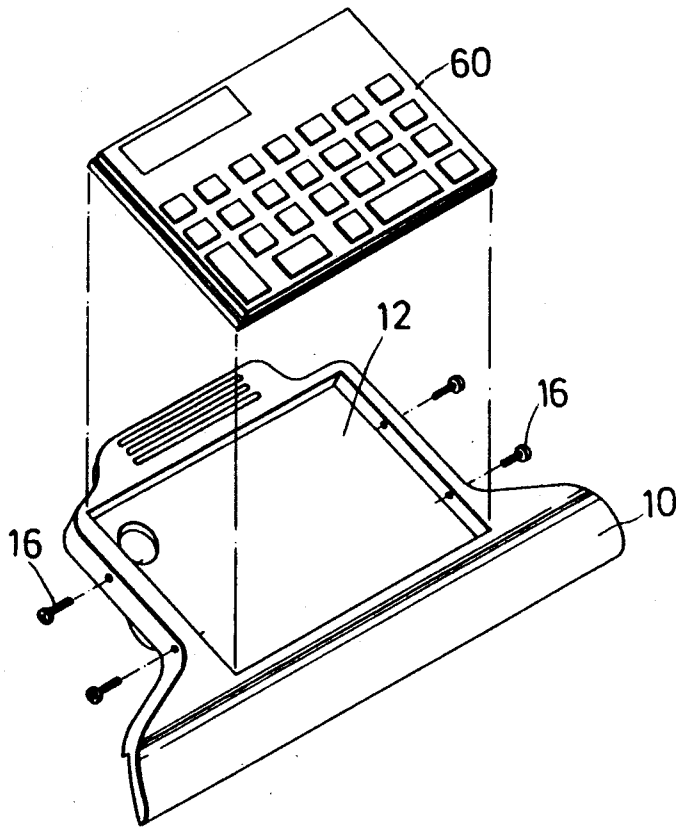
FIG. 7 is a perspective exploded view of a second preferred embodiment of a clipboard having a calculator mounted thereon according to this invention.

FIGS. 7 and 8 show two variations of the first preferred embodiment of the clipboard of this invention. In these embodiments, one or both pairs of projections 14 of the clamp member 10 are replaced with one or two pairs of screws 16 passing through the side wall of the recess 12 of the clamp member 10 in order to position the calculator 60 in the recess 12 in a manner similar to that described in the first embodiment.

Figure 9:
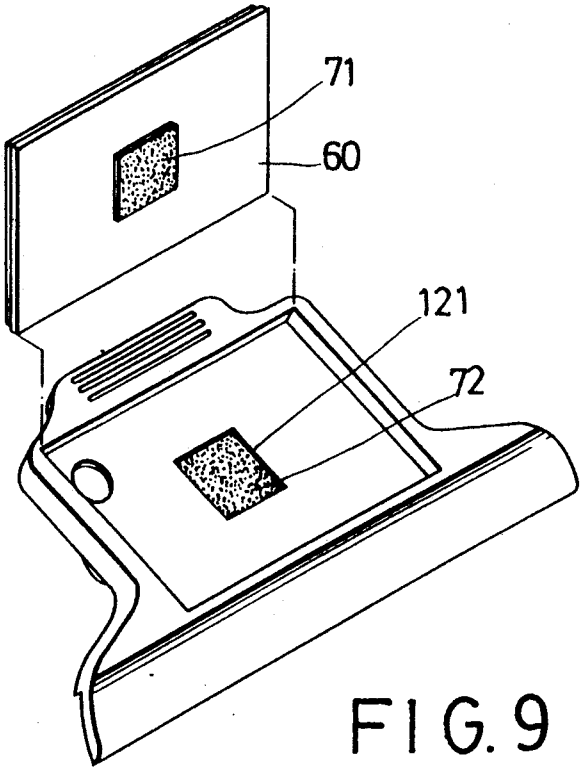
FIG. 9 is a perspective exploded view of a fourth preferred embodiment of a clipboard having a calculator mounted thereon according to this invention.

FIG. 9 shows another preferred embodiment of this invention. In this embodiment, a hook tape 71 is provided on the back of the calculator 60, and a loop tape 72 is provided in a cavity 121 formed in the bottom of the recess 12. The hook tape 71 and the loop tape 72 engage each other when the calculator 60 is received in the recess 12. In this way, the calculator 60 can be detachably positioned in the recess 12 of the clamp member 10.

Figure 10:
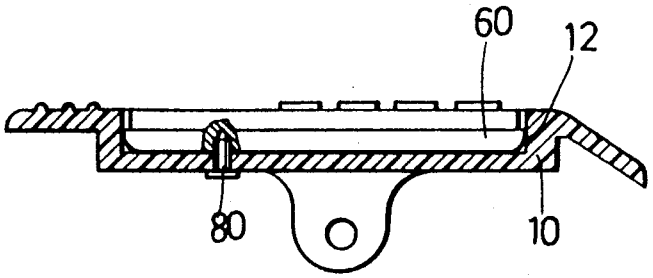
FIG. 10 is a sectional view of a fifth preferred embodiment of a clipboard having a calculator mounted thereon according to this invention.

The calculator 60 may be positioned in the recess 12 by a self-tapping screw 80 which passes through the clamp member 10 and into a position at the back side of the calculator where no circuit or electric parts are located in the calculator 60, as best illustrated in FIG. 10.

In all, it can be found that, in accordance with the present invention, the calculator 60 can be securely positioned without damaging the circuit and/or electrical parts in the calculator. In addition, the calculator 60 can be easily removed from the recess 12 of the clamp member 10 because the calculator is mounted in the front face of the clamp member 10 where a large working space is available.

With this invention thus explained, it is apparent that numerous modifications and variations can be made without departing from the scope and spirit of this invention. It is therefore intended that this invention be limited only as indicated in the appended claims.

I claim:

1. A clip board having a calculator mounted thereon, comprising:

a board having an upper side and a lower side;

a clip member having an outside face and an inside face adjacent to said upper side of said board, said outside face having an opening defining a recess therein configured to receive and peripherally surround said calculator; and means for detachably positioning aid calculator in said recess of said clip member.

2. A clipboard having a calculator mounted thereon as claimed in claim 1, wherein said calculator has a periphery having a shoulder portion formed therealong for receipt in said recess.

3. A clipboard having a calculator mounted thereon as claimed in claim 2, wherein said positioning means includes a plurality of screws protruding from an internal wall which confines said recess of said clip member, said screws abutting against said shoulder portion of said calculator when said calculator is received in said recess.

4. A clipboard having a calculator mounted thereon as claimed in claim 1, wherein said positioning means includes a Velcro strip consisting of a hook tape provided on said calculator and a loop tape provided in said recess of said clip member.

5. A clipboard having a calculator mounted thereon as claimed in claim 1, wherein said positioning means includes a screw threaded from said inside face of said clip member and into said calculator.

6. A clip board having a calculator mounted thereon, comprising:

a board having an upper side and a lower side;

a clip member having an outside face and an inside face adjacent to said upper side of said board, said outside face having a recess configured to receive said calculator, said calculator having a periphery having a shoulder portion formed therealong; and means for detachably positioning said calculator in said recess of said clip member, said positioning means including a plurality of projections protruding from an internal wall which defines said recess of said clip member, said projections abutting against said shoulder portion of said calculator when said calculator is received in said recess.

* * * * *